US008640411B1

(12) United States Patent
Wauhop

(10) Patent No.: US 8,640,411 B1
(45) Date of Patent: Feb. 4, 2014

(54) CAP BLOCK FOR CAPPING WALLS

(75) Inventor: Billy J. Wauhop, Belvidere, NJ (US)

(73) Assignee: E. Dillon & Company, Swords Creek, VA (US)

( * ) Notice: Subject to any disclaimer, the term of this patent is extended or adjusted under 35 U.S.C. 154(b) by 0 days.

(21) Appl. No.: 13/065,612

(22) Filed: Mar. 25, 2011

(51) Int. Cl.
*E04H 12/00* (2006.01)

(52) U.S. Cl.
USPC ..... 52/300

(58) Field of Classification Search
USPC ..... 52/300, 589.1, 592.1, 592.5, 592.6, 52/596, 603, 604, 605, 606, 607, 609, 612
See application file for complete search history.

(56) References Cited

U.S. PATENT DOCUMENTS 2,233,308 A * 2/1941 Duffy ..... 52/300
RE22,098 E * 5/1942 Duffy ..... 52/300
4,926,595 A * 5/1990 Dean, Jr. ..... 52/300
5,622,456 A * 4/1997 Risi et al. ..... 405/284
5,816,749 A * 10/1998 Bailey, II ..... 405/286
6,871,468 B2 * 3/2005 Whitson ..... 52/592.6
2005/0108973 A1 * 5/2005 Hammer et al. ..... 52/596
2010/0043335 A1 * 2/2010 O'Connor ..... 52/592.6
2010/0303555 A1 * 12/2010 Herse et al. ..... 405/286

* cited by examiner

*Primary Examiner* — Joshua J Michener
*Assistant Examiner* — Keith Minter
(74) *Attorney, Agent, or Firm* — Adams & Wilks

(57) ABSTRACT

A cap block has opposed top and bottom major faces bounded by two opposed side faces and two opposed end faces. The bottom face has two grooves that extend lengthwise in a side-to-side direction of the cap block from one side face to the other side face. The two grooves are spaced apart from one another in an end-to-end direction of the cap block so that the cap block can be positioned atop and cap two back-to-back walls of wall blocks with each groove receiving therein protuberances that protrude upwardly from top faces of uppermost wall blocks of respective ones of the two walls. The cap block is manufactured by molding a dry-cast concrete mixture in a mold cavity having the shape of the cap block with a base of the mold cavity corresponding to one side face of the cap block.

22 Claims, 5 Drawing Sheets

CAP BLOCK FOR CAPPING WALLS

BACKGROUND OF THE INVENTION

1. Field of the Invention

The present invention relates generally to cap blocks for capping the tops of walls and, more particularly, to cap blocks for capping the tops of double-wall structures and to a method of manufacturing cap blocks.

2. Background Information

Walls constructed of concrete blocks are commonly used in a variety of construction and landscaping applications. Examples include retaining walls, fence walls and parapet walls. These walls are typically constructed of concrete blocks, and the tops of the walls are capped with cap blocks to give the walls a finished appearance.

Concrete cap blocks are conventionally manufactured using low frequency, high amplitude vibration to consolidate concrete of stiff or extremely dry consistency in a form or mold. The cap blocks are manufactured in a flat or horizontal orientation in which a major face of the cap block (i.e., the top face or the bottom face) is formed on a production pallet. This method of manufacturing is disadvantages because it requires a large area of the production pallet per cap block because the cap blocks are molded in a horizontal orientation with the major face of the block occupying a relatively large area of the production pallet. Thus the area of coverage per mold machine cycle is limited by the size of the production pallet. Another disadvantage is that the molds are not easily filled with the same consistency during manufacturing, which results in variances in the durability of the finished product.

SUMMARY OF THE INVENTION

An object of the present invention is to provide a cap block that is economical to manufacture and easy to install.

Another object of the present invention is to provide a cap block that can cap the tops of two back-to-back walls.

A further object of the present invention is to provide a cap block that can cap the tops of two back-to-back walls by providing grooves in the cap block that receive protrusions protruding upwardly from the tops of the two walls.

Another object of the present invention is to provide a method of manufacturing a cap block by molding the cap block with opposed major faces thereof orientated vertically.

Yet another object of the present invention is to provide a method of manufacturing a plurality of cap blocks by simultaneously molding the cap blocks so that opposed major surfaces thereof are molded in a vertical orientation.

The foregoing as well as other objects of the present invention are achieved by a cap block having top and bottom faces bounded by two opposed side faces and two opposed end faces, wherein the bottom face has two-spaced apart grooves located such that when the cap block is positioned atop two back-to-back walls of wall blocks, each groove receives therein protuberances that protrude upwardly from top faces of uppermost wall blocks of respective ones of the two walls.

The two grooves preferably have a width that is 50%-100% greater than the width of the protuberances of the wall blocks. The top face of the cap block may be convexly curved and the bottom face may be flat.

The cap block is manufactured by providing a mold having a mold cavity in the shape of the cap block with a base of the mold cavity corresponding to one side face of the cap block, loading a dry-cast concrete mixture into the mold cavity of the mold, molding the concrete mixture into a cap block using the mold, discharging the molded cap block from the mold, and curing the molded cap block. During the molding step, the dry-cast concrete is consolidated using a mold shoe inserted through an open top end of the mold cavity, the mold shoe corresponding to the other side face of the cap block.

A plurality of cap blocks may be simultaneously manufactured by providing a mold having a plurality of mold cavities each in the shape of one of the cap blocks with a base of each mold cavity corresponding to one side face of one cap block, loading a dry-cast concrete mixture into the plural mold cavities of the mold, molding the concrete mixture in the mold cavities into cap blocks in a single casting process using the mold, discharging the molded cap blocks from the mold, and curing the molded cap blocks. During the molding step, the dry-cast concrete mixture in each mold cavity is consolidated using a mold shoe inserted through an open top end of each mold cavity, the mold shoes corresponding to the other side faces of the respective cap blocks.

Additional objects, advantages and features of the disclosure will be set forth in part of the description which follows, and in part will be become apparent to those skilled in the art upon examination of the following description or may be learned by practice of the disclosure.

DETAILED DESCRIPTION OF THE INVENTION

Figure 1:
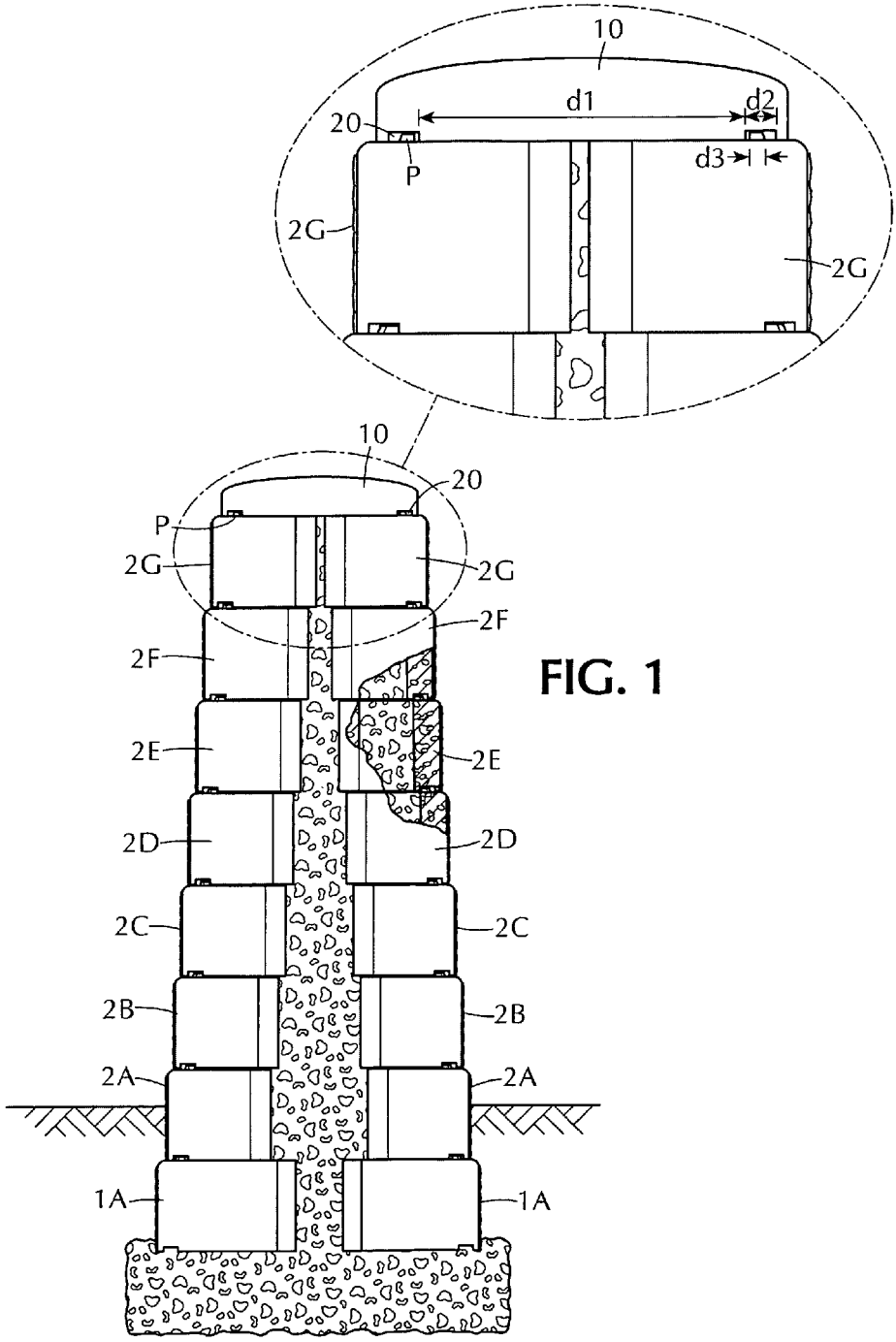
FIG. 1 is an explanatory end view, partly in section, illustrating an example of a double-wall structure capped by cap blocks according to the present invention.

The figures of the drawings are simplified for illustrative purposes and are not necessarily drawn to scale. To facilitate understanding, the same reference numerals have been used, where possible, to designate the same elements or parts that are common to the figures, and suffixes have been added, where appropriate, to differentiate elements or parts that are similar but different.

The drawings illustrate examples or embodiments of the present invention and, as such, should not be considered as limiting the scope of the invention. It is contemplated that features of one example or embodiment may be incorporated in other examples or embodiments without further recitation. Any example or embodiment described herein as "exemplary" or "alternative" is not necessarily to be construed as preferred or advantageous over other examples or embodiments.

Figure 2:
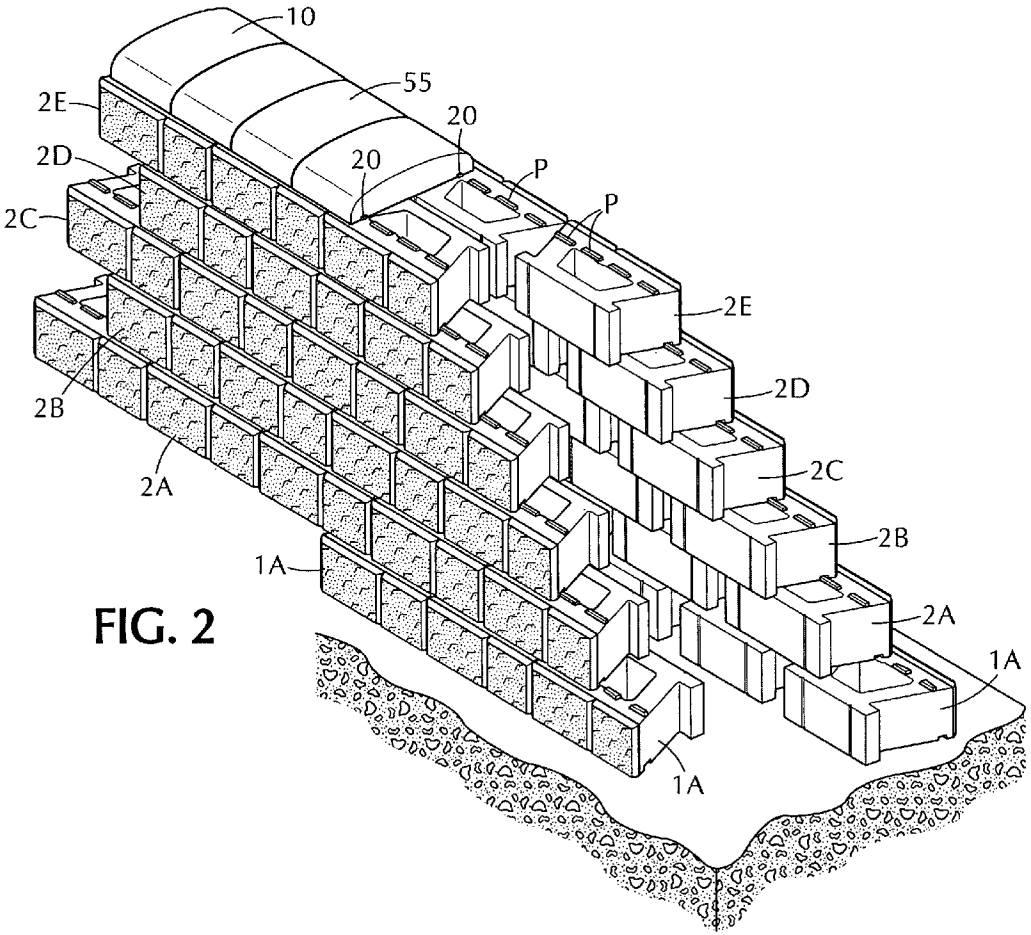
FIG. 2 is an explanatory perspective view of another example of a double-wall structure capped by cap blocks according to the present invention.

Before describing the cap block and its method of manufacture according to the present invention, a description will be given of exemplary environments in which the cap block may be used. The cap block is particularly suitable for use in capping the tops of double-wall structures; however, the cap block is not limited to capping double-wall structures and may also be used to cap single-wall and other types of wall structures. The examples illustrated in FIGS. 1 and 2 are double-wall structures having two back-to-back walls each comprised of successive courses of wall blocks dry-stacked one atop another and erected on a foundation comprised of one or more courses of base blocks. The wall blocks and base blocks are described in detail in U.S. patent application Ser. Nos. 11/900,434 (now U.S. Pat. No. 7,963,727) and 12/932,123 which are hereby incorporated by reference in their entireties. The wall blocks and the base blocks each have protuberances that protrude upwardly from the top face thereof and a groove provided in the bottom face thereof. The groove is located and dimensioned relative to the protuberances so that the grooves of the blocks in each succeeding course engage with the protuberances of the blocks in the immediately preceding course with each succeeding course set back relative to the immediately preceding course. This is described in detail in the aforesaid application Ser. Nos. 11/900,434 and 12/932,123.

FIG. 1 illustrates a double-wall structure in the form of a fence wall erected on a foundation. In this embodiment, the foundation is prepared by excavating a trench in the ground and forming a bed of crushed stone in the bottom of the trench. Two spaced-apart courses of base blocks 1A are laid on the bed of crushed stone to form a foundation. The foundation has sufficient strength to support the double-wall structure and provides a level surface on which to install the wall blocks. A first course of wall blocks 2A is dry-stacked atop each course of base blocks 1A with the wall blocks 2A set back from the base blocks 1A. A second course of wall blocks 2B is dry-stacked atop each course of wall blocks 2A with the blocks 2B set back from the blocks 2A. Successive courses of wall blocks are dry-stacked on preceding courses in the same manner to obtain two back-to-back walls each comprised of successive courses of wall blocks dry-stacked one atop another with each succeeding course set back with respect to the immediately preceding course owing to the protuberance-and-groove connection between the wall blocks in abutting courses so that the two back-to-back walls converge upwardly towards one another. A filler, such as loose stone or the like, is filled in the space between the backs of the opposed wall blocks and in the internal cavities of the wall blocks as well as in the internal cavities of the base blocks to lock the blocks together structurally. The two uppermost courses of wall blocks 2G in each wall are capped with cap blocks 10. As described hereinafter, the cap blocks 10 have two grooves each of which receives the protuberances on the top faces of the uppermost wall blocks 2G of a respective wall. To enhance watertightness and prevent unintended removal of the cap blocks 10, the cap blocks may be set in mortar to bond them to the wall blocks 2G.

In the embodiment illustrated in FIG. 2, the double-wall structure comprises a fence wall having two back-to-back walls each comprised of five courses of wall blocks 2A,2B, 2C,2D,2E erected atop a course of base blocks 1A. In this embodiment, the base blocks 1A are situated at ground level and constitute the bottom course of blocks of the fence wall. The base blocks 1A are laid in two courses on a crushed stone base, and the two courses are suitably spaced apart so that the two uppermost courses of wall blocks 2E of the two walls are properly spaced apart to receive the cap blocks 10. Each successive course of blocks in each wall is set back relative to the immediately preceding course so that the two back-to-back walls converge or slant upwardly towards one another and are capped by the cap blocks 10. The course of wall blocks 2A in each wall is set back from its underlying course of base blocks 1A, and the setback distance between the blocks 2A and the blocks 1A is the same as the setback distance between successive courses of wall blocks.

The double-wall structure is not limited to a fence wall and may be any type of wall. For example, the double-wall structure may comprise a parapet wall or similar wall-like barrier erected atop a retaining wall or other structure as disclosed, for example, in the aforesaid application Ser. No. 12/932,123.

Figure 3:
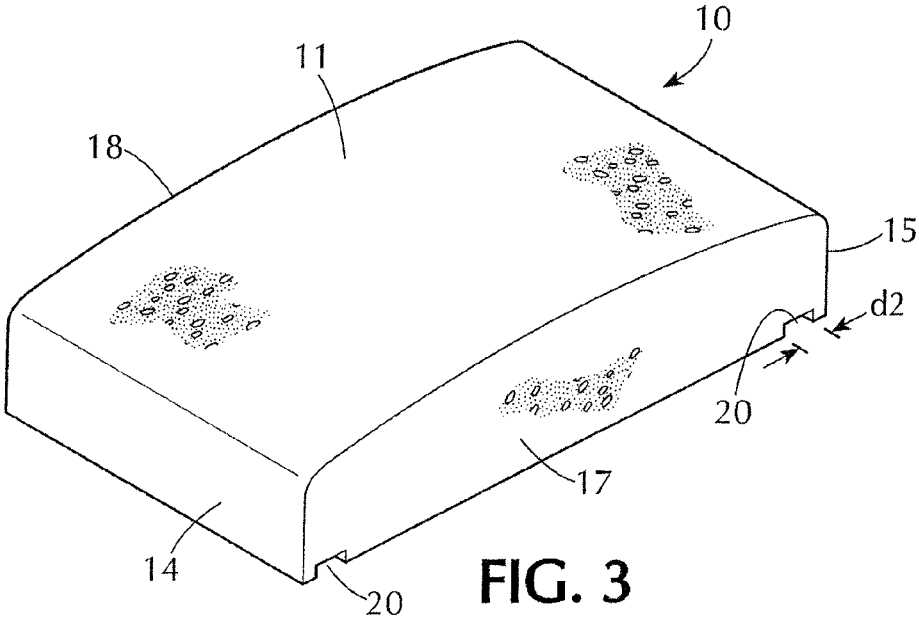
FIG. 3 is a top, corner perspective view of the cap block according to the present invention.
Figure 4:
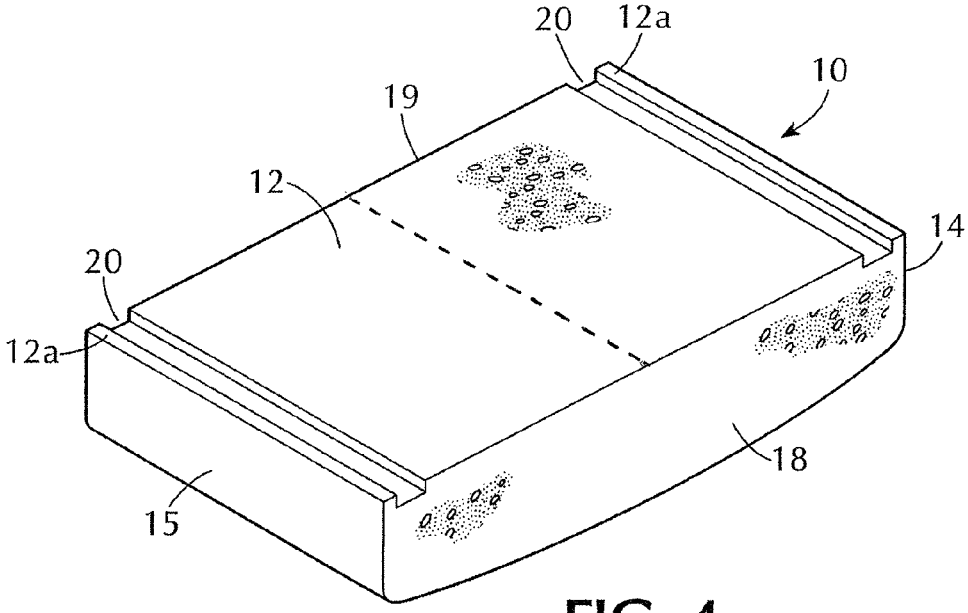
FIG. 4 is a bottom, corner perspective view of a cap block.

FIGS. 3-4 illustrate one exemplary embodiment of the cap block 10. The cap block 10 has a top face 11, a bottom face 12, two spaced-apart opposed end faces 14,15 and two spaced-apart opposed side faces 17,18. The two opposed end faces 14,15 are between the two opposed side faces 17,18, and the top and bottom faces 11,12 are bounded and separated by the two end faces and the two side faces. The opposed top and bottom faces 11,12 constitute the major faces of the cap block and are larger in size than the end faces 14,15 and the side faces 17,18. The top face 11 is an exposure face that is exposed for visibility when the cap block is installed on the top of a wall. In this embodiment, the top face 11 is domed or convexly shaped to allow for the positive run-off of rain water, melted snow and ice, etc. thereby increasing the durability of the cap block in harsh weathering environments. The bottom face 12 is preferably flat to match the top flat faces of the wall blocks on which the cap block is installed. The bottom face of the cap block need not be flat though preferably has a shape that matches the shape of the top face of the wall blocks to provide good surface-to-surface contact between the cap and wall blocks.

The bottom face 12 of the cap block 10 is provided with recessed portions, which in this embodiment are in the form of two grooves 20,20 that are parallel to one another and extend lengthwise in a side-to-side direction of the cap block from one side face 17 to the other side face 18. As used herein with reference to the cap blocks 10, the term "groove", unless otherwise qualified, is used in its broadest sense to refer to an elongate hollowed-out region, without limitation as to any particular configuration, including a channel, passage, slot and recess. As shown in FIGS. 1 and 2, the two grooves 20,20 are spaced apart a preselected distance d1 from one another in an end-to-end direction of the cap block 10 to permit the grooves to receive therein the protuberances P that protrude upwardly from the top faces of the uppermost wall blocks of respective ones of the walls. As used herein with reference to the wall blocks 2, the term "protuberance", unless otherwise qualified, is used in its broadest sense to refer to a protruding part, without limitation as to any particular configuration, including a lug, projection, knob, tab and protrusion. As shown more clearly in the enlarged section of FIG. 1, in which the dimensions of the grooves 20 and the protuberances P are exaggerated for clarity and ease of description, the width d2 of the grooves 20 is significantly greater than the width d3 of the protuberances P to permit the grooves in the cap block to fit over the protuberances on the top faces of the two uppermost courses of wall blocks 2G,2G.

To allow for slight variation in the back-to-back spacing between the two uppermost courses of wall blocks 2G,2G while permitting the protuberances P of the wall blocks to vertically align with and fit in the respective grooves 20 of the cap blocks, the width d2 of the grooves 20 is preferably about 50%-100% greater than the width d3 of the protuberances P of the wall blocks.

In the embodiments of double-wall structures illustrated in FIGS. 1 and 2, the protuberances P on the top face of the wall blocks 2 extend lengthwise in a straight line. The grooves 20 in the cap blocks 10 likewise extend linearly in a straight line in order to align with and fit over the protuberances P on the two opposed courses of wall blocks 2G,2G. The distance d1 between the two grooves 20,20 is selected in conjunction with the width d2 of the grooves and in conjunction with the location and width d3 of the protuberances P of the wall blocks 2 to insure that the two spaced-apart grooves of the cap blocks vertically align with the two rows of protuberances P on the top faces of the two uppermost courses of wall blocks 2G,2G notwithstanding variations in the spacing between the two courses of wall blocks 2G,2G. This is one reason why the width d2 of the grooves is made significantly greater, preferably 50%-100% greater, than the width d3 of the protuberances. In practice, it has been found that if the groove width d2 is 1 inch and the protuberance width d3 is ½ inch, the back-to-back spacing between two uppermost courses of wall blocks may vary between 0 and 1 inch while permitting the protuberances on the two uppermost courses of Wall blocks to vertically align with and fit in the respective grooves of the cap blocks. This tolerance of 1 inch is adequate when erecting double-wall structures in the form of fence walls, parapet walls and other walls of comparable size.

An example of a cap block 10 will be described with reference to exemplary dimensions. The exemplary dimensions are given for illustrative purposes only and are not intended to limit in any way the scope of the invention. Cap blocks according to the present invention may have different dimensions from those described below, and persons of ordinary skill in the art would be readily able to dimension the cap block 10 for use with wall blocks of different dimensions. In this example, the cap block 10 has an end-to-end dimension between the end faces 14,15 of 16¼ inches and a side-to-side dimension between the side faces 17,18 of 9 inches and the cap block has a rectangular shape when viewed from above the top face 11. The top face 11 is convexly curved with a radius of curvature of 40 inches. The maximum height of the cap block from the highest point of the top face 11 to the bottom face 12 is 4 inches. The two grooves 20,20 have a width dimension d2 of 1 inch, the width dimension d1 between the two grooves is 12½ inches and a the width dimension of the section 12*a* of the bottom face 12 between the outer walls of the grooves 20,20 and the end faces 14,15 is ⅞ inches. Such a cap block is suitable for use with wall blocks 2 of the type illustrated in FIGS. 1 and 2, in which the wall blocks have a front-to-back (depth) dimension of 9 inches, a front face length dimension of 18 inches, a back face length dimension of 15 inches, and four protuberances each having a length of 3 inches and a width of ½ inch. When such wall blocks are used to erect a double-wall structure in which the two uppermost courses of wall blocks have a back-to-back spacing between 0 and 1 inch, the cap blocks can be used to cap the two uppermost courses of wall blocks with the cap blocks in side-by-side of abutting relation and the two grooves in each cap block receiving therein the protuberances that protrude upwardly from the top faces of the uppermost wall blocks of respective ones of the walls. All of the dimensions given herein include the specified dimensions as well as values within a range of ±1/16 inch of the specified dimensions, which is an acceptable tolerance for manufactured concrete products of this type.

In the exemplary environments illustrated in FIGS. 1 and 2, the cap blocks are used to cap double-wall structures, and use of the cap blocks is not limited to such double-wall structures. The cap blocks may be used to cap single-wall structures, such as retaining walls formed of successive courses of retaining wall blocks, which may be of the type described in the aforesaid application Ser. No. 11/900,434. When used to cap single walls erected of retaining wall blocks or other types of wall blocks, only one of the two grooves at one end of the cap block would be used and would fit over the protuberances on the uppermost course of wall blocks. The other end of the cap block would overhang the back faces of the uppermost course of wall blocks. If desired, the bottom face of the cap block could be provided with a split line, shown by a dashed line in FIG. 4, that runs from one side face to the other side face at the mid-section of the block to enable the cap block to be split into two halves for use on single-wall structures. Such a split line would be formed during molding of the cap blocks.

The method of manufacturing the cap blocks 10 according to the present invention will be described with reference to FIGS. 5-8. Generally, the process is initiated by mixing dry-cast masonry concrete that will form the cap blocks. Dry-cast, low slump masonry concrete is well known in the art of casting concrete. The concrete is chosen so as to satisfy predetermined strength, water absorption, density, shrinkage, and related criteria for the cap block so that the block will perform adequately for its intended use. If desired, color can be added to the concrete mix by way of pigmentation or by the addition of colored aggregate as is well known in the art of casting concrete blocks. A person having ordinary skill in the art would be able to readily select a material constituency that satisfies the desired block criteria. Further, the procedures and equipment for mixing the constituents of the dry-cast masonry concrete are well known in the art.

Figure 6:
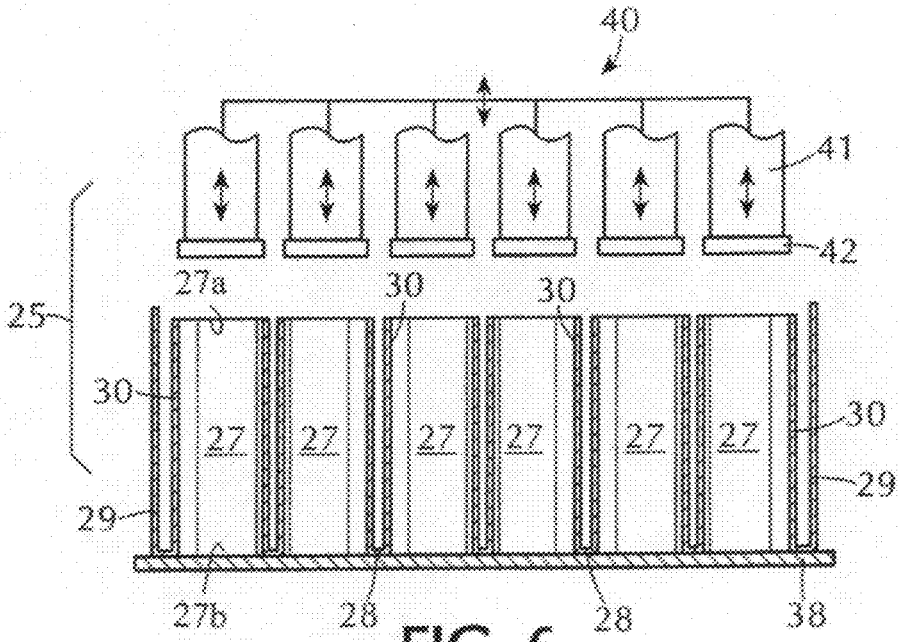
FIG. 6 is a side view, partly in cross section, of the mold box in conjunction with a plunger head assembly prior to loading a concrete mixture into the mold cavities of the six cap block molds.
Figure 7:
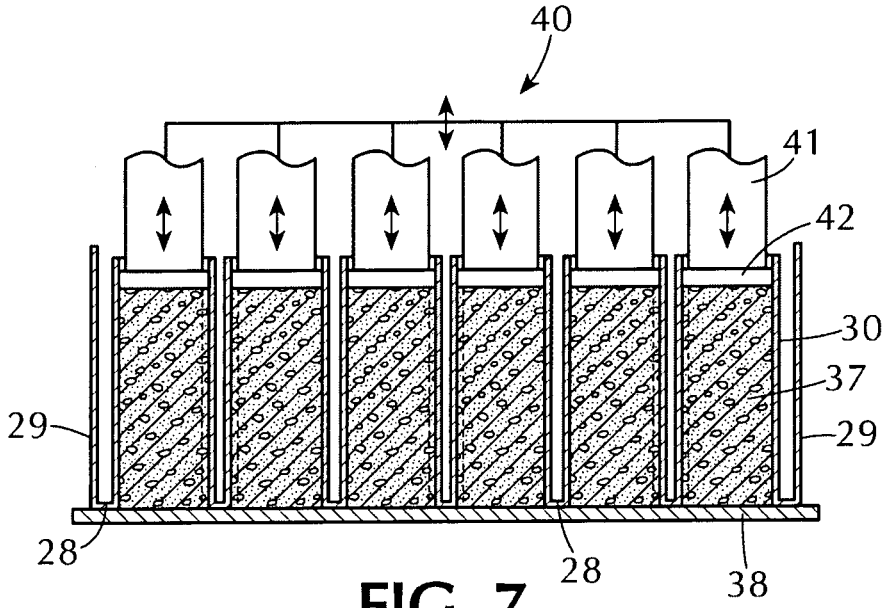
FIG. 7 is a side view, partly in cross section, showing the mold cavities loaded with a concrete mixture and the plunger head assembly in a lowered position to consolidate the cement mixture.

Once the dry-cast concrete is mixed, it is transported to a hopper (not shown), which holds the concrete near a mold 25. In this exemplary embodiment, the mold 25 is constructed to permit the simultaneous formation of six cap blocks 10 by a single casting process. The mold 25, in this exemplary embodiment, comprises a mold box 26 containing six cap block mold cavities 27. The mold box 26 may be formed by machining out a mild steel block, such as by plasma arc cutting or flame cutting, to form a mold box having a base portion 28, a peripheral rectangular wall portion 29 extending upright on the base portion 28, and six mutually spaced-apart mold parts 30 extending upright on the base portion 28 inside of the rectangular wall portion 29. The walls of the mold parts 30 have a thickness sufficient to accommodate the processing parameters of block formation. The mold box 26 constitutes a one-piece structure consisting of the base portion 28, the wall portion 29 and the mold parts 30. Each of the mold parts 30 is open at its top and bottom ends 27*a* and 27*b* as illustrated in FIGS. 6 and 7, the bottom ends 27*b* being open through correspondingly shaped openings in the base portion 28.

Figure 5:
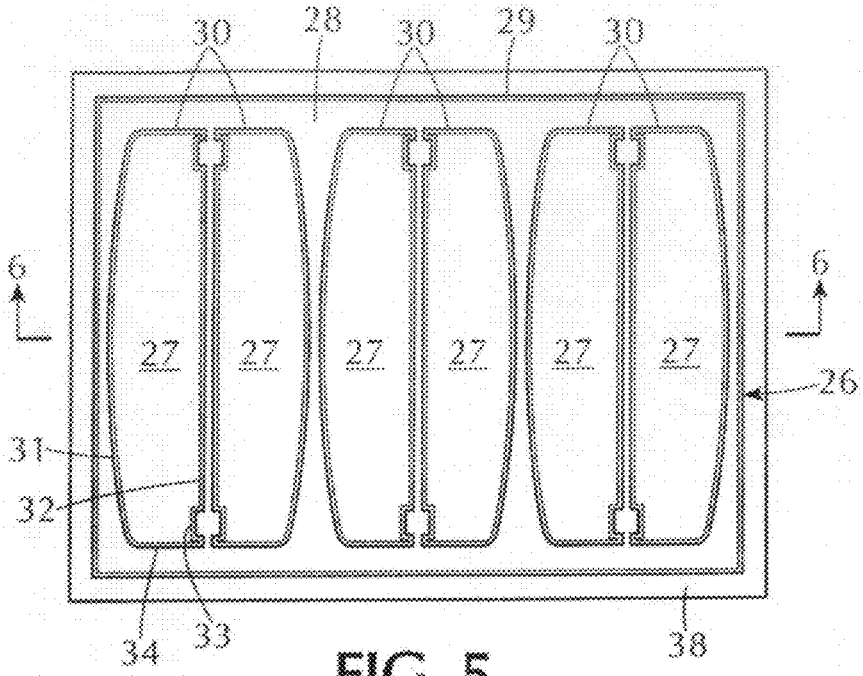
FIG. 5 is a top plan view of a mold box containing six cap block molds.

As illustrated in FIG. 5, the mold parts 30 each have a curved portion 31 whose shape corresponds to that of the curved top face 11 of the cap block, a flat portion 32 having two recessed portions 33 whose shape corresponds to that of the bottom face 12 having the two grooves 20,20, and two opposed end portions 34 whose shapes correspond to those of the two opposed end faces 14,15 of the cap block. The flat portion 32 may be provided with a projection (not shown), preferably tapered, extending parallel to the grooves 20,20 at the mid-section of the flat portion 32 to form a split line to enable subsequent splitting of the cap block into two halves for use with single-wall structures. Each mold part 30 defines one open-ended mold cavity 27 which has a shape that conforms to the top and bottom faces 11,12 and the two end faces 14,15 of the cap block.

When dry-casting the cap blocks using the mold box 26, the mold box is placed on a flat production pallet 38 made of steel, plastic or wood, for example, with the base portion 28 of the mold box sitting on the production pallet. The production pallet 38 closes the open bottom ends 27*b* of the mold cavities 27 and forms the bases of the mold cavities that corresponds in shape to one of the end faces 17 or 18 of the cap blocks. As illustrated in FIG. 6, a plunger head assembly 40 is positioned above the mold box 26. The plunger head assembly 40 has six plungers 41 each having a mold shoe 42 at its lower end. The mold shoes 42 conform in shape to the open top ends 27*a* of the mold cavities 27. The plunger head assembly 40 is displaceable between a raised position (FIG. 6) in which the mold shoes 42 are vertically spaced from the open top ends 27*a* of the mold cavities 27 and a lowered position (FIG. 7) in which the plunger head assembly 40 is lowered to insert the mold shoes 42 into the open top ends 27*a* of the mold cavities 27. The mold shoes 42 correspond in shape to the other one of the side faces 17 or 18 of the cap blocks.

The method of manufacturing cap blocks according to the present invention will be described with reference to FIGS. 6 and 7. Initially, the pallet 38 is positioned beneath the mold 25 whereby the pallet closes the bottom open ends 27*b* of the mold cavities 27. In this condition, as illustrated in FIG. 6, the plunger head assembly 40 is in the raised position. An appropriate amount of dry-cast concrete mixture 37 is loaded from the hopper into the mold cavities 27 by means of one or more feed drawers (not shown). The process and equipment for transporting the concrete mixture and loading it into the mold cavities are well known in the art.

The plunger head assembly 40 is then displaced to its lowered position (FIG. 7) in which the mold shoes 42 extend into the open top ends 27*a* of the mold cavities 27 to compact and consolidate the dry-cast concrete mixture 37. While the mold shoes 42 exert pressure on the concrete mixture in the mold cavities 27, the mold 25 is vibrated to assist in consolidating and densifying the concrete mixture.

The vibration can be exerted by vibration of the pallet 38 underlying the mold 25 (table variation), or by vibration of the mold (mold vibration), or by a combination of both actions. The timing and sequencing of the vibration and compression is variable, and depends upon the characteristics of the concrete mixture and the desired results. The selection and application of the appropriate sequencing, timing, and types of vibrational forces, are within the ordinary skill in the art. Generally, these forces contribute to fully filling the mold cavities so that there are not undesired voids in the finished cap blocks, and to densifying the dry-cast concrete mixture so that the resulting finished cap blocks 10 will have the desired weight, density, and performance characteristics.

Figure 8:
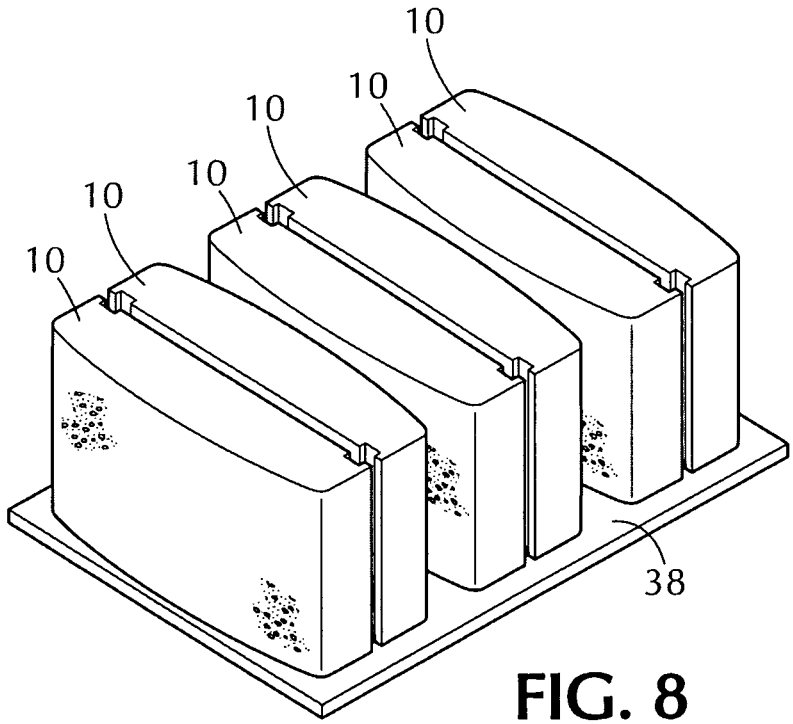
FIG. 8 is a perspective view illustrating six molded cap blocks according to the present invention.

After densification, the pre-cured cap blocks are discharged from the mold 25, preferably by lowering the pallet 38 relative to the mold. FIG. 8 shows the state of the pre-cured cap blocks 10 after removal from the mold. The pre-cured cap blocks are then transported away from the mold 25 for subsequent curing. The cap blocks may be cured through any means known to those skilled in the art. Examples of curing processes that are suitable include air curing, moist curing, autoclaving, and steam curing. Any of these processes for curing may be implemented by those of ordinary skill in the art.

In accordance with the method of manufacture according the present invention, the cap blocks are molded vertically on the production pallet rather than horizontally as is conventual in the art. In the conventional method, the cap blocks are molded in a horizontal orientation on the production pallet, wherein the open-ended mold cavities correspond to the two opposed side faces and the two opposed end faces of the cap blocks, the mold shoes that are inserted into the open top ends of the mold cavities correspond to the top faces of the blocks, and the pallet that closes the open bottom ends of the mold cavities and forms the base of the mold cavities corresponds to the bottom faces of the blocks. Stated otherwise, in the conventional method, the cap blocks are manufactured flat on the production pallet so that the area of coverage per mold machine cycle is limited to the size of the pallet with a nominal height of 4 inches (the height of the cap blocks).

By contrast, in the method of manufacture according to the present invention, the cap blocks are molded in a vertical orientation, wherein the open-ended mold cavities correspond to the opposed top and bottom and faces and the two opposed end side faces of the cap blocks, the mold shoes that are inserted into the open top ends of the mold cavities correspond to one of the two side faces of the cap blocks, and the pallet that closes the open bottom ends of the mold cavities and forms the base of the mold cavities corresponds to the other side face of the cap blocks. By molding the cap blocks vertically on the pallet in this manner, the cap blocks can be manufactured with a nominal height of approximately 9 inches instead of only 4 inches. Therefore each mold machine cycle would produce approximately double the area of finished product as compared to molding the cap blocks horizontally on the pallet in which the finished product has a nominal height of 4 inches.

Another advantage of the method of manufacture according to the present invention is that the two grooves in the bottom faces of the cap blocks can be formed directly during the molding process without the use slider bars or the like. Since the grooves extend vertically during the molding process, the cap blocks can be easily removed from the mold by simply lowering the pallet relative to the mold. This dispenses with the need of machining grooves in the bottom face, which would be required if the cap blocks were molded horizontally with the flat bottom faces of the cap blocks being formed by the flat surface of the pallet.

The method of the present invention is not, of course, limited to a mold box having six mold cavities. Any desired number of mold cavities may be provided in a single mold box.

It will be appreciated by those in the art that obvious changes can be made to the examples and embodiments described in the foregoing description without departing from the broad inventive concept thereof. It is understood, therefore, that this disclosure is not limited to the particular examples and embodiments disclosed, but it intended to cover all obvious modifications thereof which are within the scope of the disclosure as defined by the appended claims.

What is claimed is:

1. A cap block for capping two back-to-back walls formed of wall blocks, the cap block having top and bottom faces bounded by two opposed side faces and two opposed end faces and having a rectangular shape when viewed from above the top face, the bottom face having two grooves that extend lengthwise in a side-to-side direction of the cap block from one side face to the other side face, the two grooves being spaced apart a preselected distance from one another in an end-to-end direction of the cap block so that the cap block can be positioned atop and cap two back-to-back walls of wall blocks with each groove receiving therein protuberances that protrude upwardly from top faces of uppermost wall blocks of respective ones of the two walls, and the two grooves each having two opposed sidewalls that extend inwardly from the bottom face and terminate at a bottom wall, the two opposed sidewalls having the same shape and configuration throughout their extent from the bottom face to the bottom wall.

2. A cap block according to claim 1; wherein the width of the two grooves is at least 50% greater than the width of the protuberances of the wall blocks.

3. A cap block according to claim 1; wherein the two grooves have a uniform width throughout their length.

4. A cap block according to claim 3; wherein the two grooves are parallel to one another.

5. A cap block according to claim 1; wherein the two grooves are located adjacent respective end faces, and the distance between each groove and its respective end face is less than the width of the groove.

6. A cap block according to claim 1; wherein the two grooves extend linearly from one side face to the other side face.

7. A cap block according to claim 6; wherein the two grooves have a uniform width throughout the length thereof.

8. A cap block according to claim 1; wherein the mid-portion of the top face between the two end faces is convexly curved and the bottom face is flat.

9. A cap block according to claim 1; wherein the distance between the two end faces is greater than the distance between the two side faces.

10. A cap block according to claim 1; wherein the cap block is a molded dry-cast concrete structure.

11. A cap block according to claim 1; wherein the width of the two grooves is about 100% greater than the width of the protuberances of the wall blocks.

12. A cap block according to claim 1; wherein each of the two grooves has a width 50%-100% greater than that of the protuberances of the wall block.

13. A cap block according to claim 1; wherein the top and bottom faces are opposed to one another and constitute major faces of the cap block.

14. A cap block according to claim 1; wherein the top face is convexly curved throughout its length from one end face to the other end face.

15. A cap block for capping the top of a wall, the cap block having top and bottom faces bounded by two opposed side faces and two opposed end faces and having a rectangular shape when viewed from above the top face, the bottom face having recessed portions that are positioned and configured to receive therein protuberances that protrude upwardly from the top of a wall when the cap block is installed on the top of the wall, wherein the recessed portions each have two opposed sidewalls that extend inwardly from the bottom face and terminate at a bottom wall, the two opposed sidewalls having the same shape and configuration throughout their extent from the bottom face to the bottom wall.

16. A cap block according to claim 15; wherein the recessed portions have the same size and shape.

17. A cap block according to claim 15; wherein the recessed portions are located on the bottom face closer to the end faces than to the center of the bottom face.

18. A cap block according to claim 15; wherein the recessed portions comprise grooves.

19. A cap block according to claim 18; wherein the grooves extend lengthwise in a side-to-side direction of the cap block.

20. A cap block according to claim 15; wherein the mid-portion of the top face between the two end faces is convexly curved.

21. A cap block according to claim 15; wherein the top face is convexly curved throughout its length from one end face to the other end face.

22. A cap block according to claim 15; wherein the recessed portions have a width 50%-100% greater than that of the protuberances.

* * * * *